United States Patent [19]

Bissot

[11] Patent Number: 4,584,071

[45] Date of Patent: Apr. 22, 1986

[54] PROCESS FOR ELECTROLYSIS OF BRINE WITH IODIDE IMPURITIES

[75] Inventor: Thomas C. Bissot, Newark, Del.

[73] Assignee: E. I. Du Pont de Nemours and Company, Wilmington, Del.

[21] Appl. No.: 690,481

[22] PCT Filed: Mar. 30, 1983

[86] PCT No.: PCT/US83/00445

§ 371 Date: Oct. 30, 1984

§ 102(e) Date: Oct. 30, 1984

[87] PCT Pub. No.: WO84/03904

PCT Pub. Date: Oct. 11, 1984

[51] Int. Cl.[4] ..... C25B 1/16; C25B 1/26

[52] U.S. Cl. ..... 204/98; 204/128; 210/683

[58] Field of Search ..... 204/98, 128; 210/683

[56] References Cited

U.S. PATENT DOCUMENTS

| | | | |
|---|---|---|---|
| 1,051,984 | 2/1913 | Cameron | 204/128 |
| 1,843,127 | 2/1932 | Girvin | 204/128 |
| 2,982,608 | 5/1961 | Clement | 204/98 |
| 3,660,261 | 5/1972 | Wright et al. | 204/98 |
| 4,038,365 | 7/1977 | Patil et al. | 204/98 |
| 4,060,465 | 11/1977 | Yokota et al. | 204/128 |
| 4,116,781 | 9/1978 | Dorio et al. | 204/98 |
| 4,155,820 | 5/1979 | Ogawa et al. | 204/98 |
| 4,176,022 | 11/1979 | Darlington | 204/98 |
| 4,202,743 | 5/1980 | Oda et al. | 204/98 |
| 4,207,152 | 6/1980 | Kadija et al. | 204/98 |
| 4,483,754 | 11/1984 | Shiroki | 204/98 |

*Primary Examiner*—John F. Niebling
*Assistant Examiner*—Terryence Chapman

[57] ABSTRACT

There is disclosed a process for producing chlorine and an alkali metal hydroxide from brines containing soluble, iodine-containing salts by the electrolysis of aqueous alkali metal chloride in an electrolytic cell comprising an anode compartment and a cathode compartment separated by a fluorocarbon cation exchange membrane and in which the alkali metal chloride fed to the anode compartment contains not more than 1 ppm, preferably not more than 0.4 ppm of soluble iodine-containing salts.

4 Claims, No Drawings

PROCESS FOR ELECTROLYSIS OF BRINE WITH IODIDE IMPURITIES

DETAILED DESCRIPTION OF THE INVENTION

This invention relates to the electrolysis of aqueous alkali metal chloride solutions, using a fluorinated membrane between the anode and cathode. In particular, it relates to such a process in which the ionic iodide or iodate content of the anolyte feed is maintained below 1 ppm.

Iodine, when present in brine, is generally in the form of sodium iodide. Many sources of brine contain less than 1 ppm iodine, but higher levels are found in brine associated with oil and gas fields and in salt deposited from sea water. Sea water contains about 35,000 ppm total salts and 0.05 ppm iodine which is equivalent to approximately 0.5 ppm iodine in concentrated brine solutions. Further, iodine can be concentrated in certain seaweeds, which may explain the observation that some salt deposits from prehistoric seas contain up to 100–200 ppm iodine. High iodine content has been reported for brines in Michigan, Oklahoma, Louisiana, California and Japan.

There has now been discovered an improved electrolytic process for the production of chlorine and an alkali metal hydroxide containing soluble, iodine-containing salts and employing an electrolytic cell comprising an anode compartment containing an anode and aqueous alkali metal chloride and a cathode compartment containing a cathode and aqueous alkali metal hydroxide separated by a fluorocarbon cation-exchange membrane containing at least one of the types of cation exchange groups selected from carboxyl cation-exchange groups and sulfonyl cation-exchange groups and through which an electrical current is passed at a current density in the range of 20 to 80 A/dm$^2$, preferably 30 to 50 A/dm$^2$ while continuously adding concentrated alkali metal chloride free from harmful levels of alkaline earth salts and iron or other heavy metal salts to the anode compartment and continuously removing chlorine and depleted anolyte solution from the anode compartment and continuously adding water or dilute alkali metal hydroxide to the cathode compartment and continuously removing alkali metal hydroxide having a concentration maintained at a value between 20% and 45% by weight, preferably between 25% and 35% by weight from the cathode compartment, in which the improvement comprises maintaining the concentration of soluble iodine-containing salts in the concentrated alkali metal chloride added to the anode compartment at a concentration not higher than 1 ppm, preferably not higher than 0.4 ppm.

Particularly preferred for use in the above process are perfluorinated membranes, especially bimembranes having a layer containing carboxyl groups facing the catholyte and a layer containing sulfonyl groups facing the anolyte. Current efficiencies above 90% can readily be obtained and maintained for long periods of time, that is for two or more years, by operating according to this process. The process is particularly useful commercially for preparing concentrated caustic soda (NaOH) from sodium chloride brine but can also be applied to the commercial production of potassium hydroxide from potassium chloride solution.

In the event that the raw brines available naturally contain more than 1 ppm of soluble, iodine-containing salts, such as sodium iodide or sodium iodate, methods are known in the art for removing these iodine-containing salts. A useful reference is Kirk-Othmer, "Encyclopedia of Chemical Technology", 3rd Edition, volume 13, pp. 649–677, John Wiley & Sons, N.Y. 1981. Other methods for removing iodide from brine are taught in "Ultrapurity-Methods and Techniques" edited by Morris Zief and Robert Speights, Marcel Dekker, Inc. New York, N.Y., 1972. In the event that very pure brine free from soluble iodine-containing salts is also available, a brine solution containing less than 1 ppm soluble, iodine-containing salts can be prepared by mixing the brine containing more than 1 ppm of the iodine-containing impurity with sufficient of the very pure brine to reduce the level of iodine-containing salts to 1 ppm or below in the mixed brine.

In laboratory electrolysis using brine with added sodium iodide, iodine accumulated to greater than 10 mg/dm$^2$ in test membranes, and caustic current efficiency was reduced by greater than 5% after 2 weeks of operation at 100 ppm iodide in the brine. At 10 ppm iodide in the brine, most membranes showed reduced current efficiency and iodine contents of about 2 mg/dm$^2$ after 2–3 weeks of operation. At 1 ppm iodide, current efficiency was unchanged after 4 weeks, but the iodine level in the membranes indicated that performance problems would develop with continued operation. Decreased current efficiency was observed only with membranes which had accumulated 1 mg/dm$^2$ or more of iodine. All of these tests were made while producing 32% caustic by electrolysis of brine.

The iodine deposit in the membrane was identified by X-ray diffraction as sodium paraperiodate, $Na_3H_2IO_6$. While our invention is not to be construed to be limited thereby, we believe that the chlorine present in the anode chamber oxidizes iodide (and other iodine-containing ions) to iodate. Sodium iodate is only partially dissociated in brine, and a portion is carried along with the water accompanying sodium ions as they pass through the cation exchange membrane (electroosmosis). As the iodate reaches the zone of increased alkalinity near the cathode face of the membrane it is oxidized to a periodate, probably by hypochlorite, and precipitates as the alkali-insoluble trisodium paraperiodate. Disodium and trisodium paraperiodates are among the most insoluble sodium salts known and were considered in the early literature as a method for the quantitative gravimetric analysis of sodium ion.

Our experiments included reinforced and unreinforced perfluorocarbon membranes in both zero gap and finite gap membrane cells. Similar results were obtained with a membrane containing only carboxyl groups and bimembranes with a layer of carboxyl polymer next to the catholyte and a layer of sulfonyl polymer next to the anolyte.

The membranes used in the instant invention are of types known in the art. These include fluorinated polymers with pendant side chains containing carboxylic acid groups and/or sulfonic acid groups, or their derivatives.

The carboxylic polymers with which the present invention is concerned have a fluorinated hydrocarbon backbone chain to which are attached the functional groups or pendant side chains which in turn carry the functional groups. When the polymer is in melt-fabricable form, the pendant side chains can contain, for example, $$\underset{\underset{Z\ t}{|}}{CF\ W}$$

groups wherein Z is F or $CF_3$, t is 1 to 12, and W is —COOR or —CN, wherein R is lower alkyl. Preferably, the functional group in the side chains of the polymer will be present in terminal $$\underset{\underset{Z\ t}{|}}{OCF\ W}$$

groups wherein t is 1 to 3.

By "fluorinated polymer" is meant a polymer in which, after loss of any R group by hydrolysis to ion exchange form, the number of F atoms is at least 90% of the total number of F, H and Cl atoms in the polymer. For chloralkali cells, perfluorinated polymers are preferred, though the R in any COOR groups need not be fluorinated because it is lost during hydrolysis.

Polymers containing $$-(OCF_2\underset{\underset{CF_3}{|}}{CF})_mOCF_2\underset{\underset{CF_3}{|}}{CFCN}$$

side chains, in which m is 0, 1, 2, 3 or 4, are disclosed in U.S. Pat. No. 3,852,326.

Polymers containing $-(CF_2)_p$ COOR side chains, where p is 1 to 18, are disclosed in U.S. Pat. No. 3,506,635.

Polymers containing $$-(OCF_2\underset{\underset{Z}{|}}{CF})_mOCF_2COOR$$

side chains, where Z and R have the meaning defined above and m is 0, 1, or 2 (preferably 1) are disclosed in U.S. Pat. No. 4,267,364.

Polymers containing terminal $-O(CF_2)_vW$ groups, where W is as defined above and v is from 2 to 12, are preferred. They are disclosed in U.S. Pat. Nos. 3,641,104, 4,178,218, 4,116,888, British 2,053,902A, EP 41737 and British 1,518,387. These groups may be part of $$-(OCF_2\underset{\underset{Y}{|}}{CF})_m-O-(CF_2)_v-W$$

side chains, where Y=F or $CF_3$ or $CF_2Cl$. Especially preferred are polymers containing such side chains where v is 2, which are described in U.S. Pat. No. 4,138,426 and S. Afr. 78/002225, and where v is 3, which are described in U.S. Pat. No. 4,065,366. Among these polymers, those with m=1 and Y=$CF_3$ are most preferred.

The above references described how to make these polymers.

The sulfonyl polymers with which the present invention is concerned are fluorinated polymers with side chains containing the group $$-CF_2\underset{\underset{R_f}{|}}{CF}SO_2X,$$

wherein $R_f$ is F, Cl, $CF_2Cl$ or a $C_1$ to $C_{10}$ perfluoroalkyl radical, and X is F or Cl, preferably F. Ordinarily, the side chains will contain $-OCF_2CF_2CF_2SO_2X$ or $-OCF_2CF_2SO_2F$ groups, preferably the latter. The term "fluorinated polymer" carries the same meaning as employed above in reference to carboxylate polymers. For use in chloralkali membranes, perfluorinated copolymers are preferred.

Polymers containing the side chain $$-O(CF_2\underset{\underset{CF_3}{|}}{CFO})_k-(CF_2)_j-SO_2F,$$

where k is 0 or 1 and j is 3, 4, or 5, may be used. These are described in British 2,053,902A.

Polymers containing the side chain $-CF_2CF_2SO_2X$ are described in U.S. Pat. No. 3,718,627.

Preferred polymers contain the side chain $$-(OCF_2\underset{\underset{Y}{|}}{CF})_r-OCF_2\underset{\underset{R_f}{|}}{CFSO_2X},$$

where $R_f$, Y, and X are as defined above and r is 1, 2, or 3, and are described in U.S. Pat. No. 3,282,875. Especially preferred are copolymers containing the side chain $$-OCF_2\underset{\underset{CF_3}{|}}{CF}OCF_2CF_2SO_2F.$$

Polymerization can be carried out by the methods described in the above references. Especially useful is solution polymerization using $ClF_2CCFCl_2$ solvent and $(CF_3CF_2COO\rightarrow)_2$ initiator. Polymerization can also be carried out by aqueous granular polymerization as in U.S. Pat. No. 2,393,967, or aqueous dispersion polymerization as in U.S. Pat. No. 2,559,752 followed by coagulation as in U.S. Pat. No. 2,593,583.

The copolymers used in the layers described herein should be of high enough molecular weight to produce films which are self-supporting in both the melt-fabricable precursor form and in the hydrolyzed ion exchange form.

A fluorinated or perfluorinated copolymer which contains different types of functional groups can also be used in making the membrane of the invention. For example, a terpolymer prepared from a nonfunctional monomer, a carboxyl monomer, and additionally a sulfonyl monomer, can be prepared and used as the membrane or as one of the film components in making the membrane.

It is further possible to use as the membrane or as one of the component films of the membrane a film which is a blend of two or more polymers. For example, a blend of a polymer having sulfonyl groups in melt-fabricable form with a polymer having carboxyl groups in melt-fabricable form can be prepared and used as one of the component films of the membrane of this invention.

It is additionally possible and in fact preferred to use a laminar film as the membrane or as one of the component films in making the membrane. For example, a membrane having at least one layer of a copolymer having sulfonyl groups in melt-fabricable form and a layer of a copolymer having carboxyl groups in melt-fabricable form, such as made by coextrusion, can also be used as the membrane or as one of the component films in making the membrane of the invention. Such a laminated structure may be referred to in this application as a bimembrane. Preparation of bimembranes is described in Japanese laid-open application number K52/36589.

The customary way to specify the structural composition of films or membranes in this field of art is to specify the polymer composition, ion-exchange capacity or its reciprocal, equivalent weight, and thickness of the polymer films in melt-fabricable form, from which the membrane is fabricated. This is done because the measured thickness varies depending on whether the membrane is dry or swollen with water or an electrolyte, and even on the ionic species and ionic strength of the electrolyte, even though the amount of polymer remains constant.

For use in ion exchange applications and in cells, for example a chloralkali cell for electrolysis of brine, the membrane should have all of the functional groups converted to ionizable functional groups. Ordinarily and preferably these will be sulfonic acid and carboxylic acid groups, or preferably alkali metal salts thereof. Such conversion is ordinarily and conveniently accomplished by hydrolysis with acid or base, such that the various functional groups described above in relation to the melt-fabricable polymers are converted respectively to the free acids or the alkali metal or ammonium salts thereof. Such hydrolysis can be carried out with an aqueous solution of a mineral acid or an alkali metal hydroxide. Base hydrolysis is preferred as it is faster and more complete. Use of hot solutions, such as near the boiling point of the solution, is preferred for rapid hydrolysis. The time required for hydrolysis increases with the thickness of the structure. It is also of advantage to include a water-miscible organic compound such as dimethyl sulfoxide in the hydrolysis bath, to swell the membrane to increase the rate of hydrolysis.

Membranes usually have an overall thickness of 50–250 micrometers, especially 125–200 micrometers. The ion-exchange capacity of the carboxylate polymer is in the range of 0.7–1.4 meq/g, preferably 0.8–1.2 meq/g dry resin, with lower ion-exchange capacities providing more dilute caustic during operation of a chlor-alkali cell at maximum current efficiency. The ion-exchange capacity of the sulfonate polymer is in the range of 0.5–1.5 meq/g, preferably 0.7–1.2 meq/g dry resin.

The membrane may be unreinforced, but for dimensional stability and greater notched tear resistance, it is common to use a reinforcing material. It is customary to use a fabric made of a fluorocarbon resin such as polytetrafluoroethylene or a copolymer of tetrafluoroethylene with hexafluoropropylene (Teflon® FEP fluorocarbon resin) or with perfluoro-(propyl vinyl ether) Teflon® PFA fluorocarbon resin). These may be woven into fabric using various weaves, such as the plain weave, basket weave, leno weave, or others. Relatively open weaves are favorable in that electrical resistance is lower. Porous sheet such as disclosed in U.S. Pat. No. 3,962,153 may be used as a support. Other perhalogenated polymers such as polychlorotrifluoroethylene may also be used, but perfluorinated supports have the best resistance to heat and chemicals. The fibers used in the support fabrics may be monofilaments or multifilament yarns. They may be of ordinary round cross-section or may have specialized cross-sections. Oblong or rectangular cross-sections, if suitably oriented to the membrane, make it possible to get more reinforcing action with a thinner overall membrane. It may be desirable to use soluble or degradable fibers, such as rayon or paper, along with the fluorocarbon fibers, or in place of the fluorocarbon fibers. Care should be taken, however, not to have the soluble or degradable fibers extend from one surface to the other, or the non-porous membrane will become a porous diaphragm and, in the case of a chloralkali cell, the caustic will contain too much salt. Even with a cloth or mesh of fluorocarbon fibers, it is preferred not to have the cloth penetrate the surface of the membrane on the cathode side. The fabric employed may be calendered before lamination to reduce its thickness. In a bimembrane, the fabric may be in the sulfonate or carboxylate layer or both, but is more often in the sulfonate layer, which is usually thicker. In place of fabric, non-woven fibrils can be used.

The membrane or bimembrane may be used flat in various known filter press cells, or may be shaped around an electrode. The latter is especially useful when it is desired to convert an existing diaphragm cell to a membrane cell in order to make better quality caustic.

New or used membranes may be swelled with polar solvents (such as lower alcohols or esters, tetrahydrofuran, or chloroform) and then dried, preferably between flat plates, to improve their electrtolytic performance. Before mounting in commerical cell support frames, which may be 1–3 meters on a side, the membrane may be swelled so that it will not wrinkle after it is clamped in the frame and exposed to electrolytic fluids. Among the swelling agents that can be used are water, brine, caustic, lower alcohols, glycols, and mixtures thereof.

Potassium hydroxide is made in the chloralkali cell when the anolyte is potassium chloride.

The cell can have two or three compartments, or even more. If three or more compartments are used, the membrane is commonly used next to the cathode compartment, and the other dividers may be porous diaphragms or membranes based on polymers having pendant side-chains with terminal $—CF_2—SO_3^-$ion exchange groups only. However, the membrane may be next to the anolyte.

Bipolar or monopolar cells can be used. In ordinary use, the carboxylate side of the membrane will face the cathode. One can use (n) cells in series, with anolyte flowing from cell (l) to cell (n) and catholyte flowing from cell (n) to cell (l). All these cells may use identical membranes or different membranes may be used in different cells. Membranes using only polymers having pendant side chains with terminal $—CF_2—SO_3^-$groups may be used in cell (n) and possibly others near it. Cell (n) may be two or more cells in parallel.

The membrane may be disposed horizontally or vertically in the cell, or at any angle from the vertical.

Any of the conventional electrodes or electrode configurations may be used. The anode for a chlor-alkali cell should be resistant to corrosion by brine and chlorine, resistant to erosion, and preferably may contain an electrocatalyst to minimize chlorine overvoltage. The well-known dimensionally stable anode is among those that are suitable. A suitable base metal is titanium, and the electrocatalysts include reduced platinum group metal oxides (such as Ru, etc) singly or in mixtures, optionally admixed with a reduced oxide of Ti, Ta, Cb, Zr, Hf, V, Pt, or Ir. They may be heat treated for stability.

The anode may be a 'zero-gap' anode, against which the membrane is urged and which anode is permeable to both liquids and gases. The anode may be kept a small distance from the membrane by the use of a spacer, against which the membrane is urged by a small hydraulic head on the other side of the membrane. The spacer may be made of a plastic which is resistant to the chemicals in the anolyte, such as polytetrafluoroethylene, ethylene/tetrafluoroethylene copolymer, or polychlorotrifluoroethylene. It is desirable that the spacer or electrode should have open vertical channels or grooves to facilitate the evolution of the anode gas. Whether or not there is a spacer, it may be desirable to have the anode openings slanted so the gas is carried away from the membrane and anolyte circulation past the membrane is maximized. This effect can be augmented by using downcomers for anolyte which has been lifted by the rising gas bubbles. The anode may be a screen or perforated plate or powder which is partially embedded in the anode surface layer of the bimembrane. In this case, the current may be supplied to the anode by current distributors which contact the anode at numerous closely-spaced points. The anode may be a porous catalytic anode attached to or pressed against the membrane or attached to or pressed against a porous layer, which is in turn attached to or pressed against the membrane.

The cathode for a chloralkali cell should be resistant to corrosion by the catholyte, resistant to erosion, and preferably may contain an electrocatalyst to minimize hydrogen overvoltage. The cathode may be mild steel, nickel, or stainless steel, for example, and the electrocatalyst may be platinum black, palladium, gold, spinels, manganese, cobalt, nickel, Raney nickel, reduced platinum group metal oxides, or alpha-iron.

The cathode may be a 'zero-gap' cathode, against which the membrane is urged and which cathode is permeable to both liquids and gases. The cathode may be kept a small distance from the membrane by the use of a spacer, against which the membrane is urged by a small hydraulic head on the other side of the membrane. In the case of a three-compartment cell, both membranes may be urged against electrodes or spacers by a hydraulic head on the center compartment. The spacer may be made of a plastic which is resistant to the chemicals in the catholyte, such as polytetrafluoroethylene, ethylene/tetrafluoroethylene resin, or polychlorotrifluoroethylene. It is desirable that the cathode spacer or electrode have open vertical channels or grooves to facilitate the evolution of the cathode gas, which is hydrogen in many cell processes. Whether or not there is a spacer, it may be desirable to have the cathode openings slanted so the gas is carried away from the membrane and catholyte flow past the membrane is maximized. This effect may be augmented by using downcomers for catholyte which has been lifted by rising gas bubbles. The cathode may be a screen or perforated plate or powder which is partially embedded in the cathode surface layer of the bimembrane. In this case, the current may be supplied to the cathode by current distributors which contact the cathode at numberous closely-spaced points. The cathode may be a porous cathode, attached to or pressed against the membrane or attached to or pressed against a porous layer, which is in turn attached to or pressed against the membrane.

An oxygen cathode can be used, in which oxygen is supplied to the cathode and substantially no hydrogen is evolved, with the result being lower cell voltage. The oxygen may be supplied either by bubbling through the catholyte and against the cathode, or by feeding oxygen-containing gas through a porous inlet tube which also serves as cathode and is coated with electrocatalyst.

It has long been known that in the electrolysis of brine to make chlorine and caustic, it is desirable to use NaCl of low Ca and Mg content (Kobe, Inorganic Process Industries, MacMillian, 1948, p. 130; Rogers' Industrial Chemistry, Van Nostrand, 1942, p. 362). This is stated for electrolysis in general, for diaphragm electrolysis, for mercury electrolysis, and for membrane electrolysis (Water Pollution Control Research Series "Hypochlorite Generator for Treatment of Combined Sewer Overflows," 1972, U.S. Environmental Protection Agency, pp. 60–61). It was also well known how to remove hardness from sodium chloride solutions to very low levels. Heavy metals like iron and mercury should also be substantially removed. Some of the contaminants in make-up brine can be removed by passing the brine through a diaphragm cell before it is fed to the membrane cell system. Further hardness reductions can be achieved by passing the brine through a chelate ion exchanger, preferably one containing $—NHCH_2COOH$ groups, or a phosphate may be added to the brine to precipitate insoluble salts.

Brine fed to the cell is usually close to the saturation concentration, but lower brine concentration is acceptable. Brine leaving the anolyte chamber may be as low as about 2% by weight NaCl, but is more often 10–15 wt % NaCl, or even higher.

Because a bimembrane has lower electrical resistance than an all-carboxylate membrane, it can be operated at lower voltage or higher current density. Good long-term results have been obtained at 30–50 $A/dm^2$, and short runs have operated successfully at still higher current density.

It is desirable to acidify the anolyte to minimize the formation of oxygen and chlorate at the anode. Overacidification of a bimembrane is not as serious an error in the case of a bimembrane as in the case of an all-carboxylate membrane, because the $—CF_2SO_3H$ group is a stronger acid than the $—CF_2COOH$ group, and the sulfonate form, $—CF_2SO_3^-$, resists conversion to the acid form by overacidification more strongly than does the carboxylate ion form. The free acids are to be avoided because they increase membrane voltage.

Anolyte acidity is normally adjusted to a value in the range of pH 1–5 by addition of hydrochloric acid or hydrogen chloride to the recycle brine. Recycle brine may be concentrated by addition of solid salt and/or by evaporating or distilling water from the stream.

While membrane cells are frequently operated at approximately atmospheric pressure, there can be advantages to operating them at elevated pressure. While direct current is ordinarily used in membrane cells, one can also use pulsed direct current or half-wave AC or rectified AC or DC with a square wave.

Chloro-alkali synthesis is normally carried out at about 70°–100° C. The catholyte can be kept 5°–20° cooler than the anolyte temperature.

EXAMPLE 1

A ion exchange membrane cell was set up having an electrode active area of 45 $cm^2$. The zero-gap cell had a DSA anode made of a $RuO_2$—$TiO_2$ mixture coated on titanium expanded metal mesh and a Raney nickel activated nickel cathode. The ion exchange membrane was a hydrolyzed unsupported bimembrane made from 38 microns of a $CF_2{=}CF_2/CF_2{=}CFOCF_2CF(CF_3)OCF_2CF_2COOCH_3$ copolymer having ion exchange capacity of 0.95 meq/g and 100 microns of a $CF_2{=}CF_2/CF_2{=}CFOCF_2CF(CF_3)OCF_2CF_2SO_2F$ copolymer having ion exchange capacity of 0.93 meq/g. Asbestos paper was placed between the cathode and the ion exchange membrane as a hydrogen bubble release layer. The cell was started while feeding purified, saturated brine containing no detectable iodide. This cell was operated at 3.1 $KA/m^2$, 90° C., 32% NaOH, 200 g/l NaCl in anolyte; water was fed to the catholyte chamber, sat. brine was fed to the anolyte chamber; there was no recirculation of the electrolyte. After two days the feed was changed to an iodide-contaminated saturated brine containing 100 ppm iodide which was prepared by adding the calculated amount of sodium iodide to iodide-free brine. Initially the current efficiency was 96%, but after 10 days it had declined to 83%. Upon removal from the cell the membrane was examined by scanning electron microscope. Deposits of an iodine-containing impurity were found in the cathode face of the membrane resulting in holes and pits in the cathode surface of the membrane. This damage caused by the iodide impurities severely reduced the useful life of the ion exchange membrane.

EXAMPLE 2

Example 1 was repeated except that the feed brine contained 10 ppm iodide. After 13 days of operation the current efficiency had declined from 94% to 89%, and examination showed iodide deposits in the cathode face.

EXAMPLE 3

Example 1 was repeated except that the feed brine contained 1 ppm iodide. Initially the current efficiency was 94%; after 43 days of operation it had not declined. Examination detected only traces of iodide and no damage to the membrane.

I claim:

1. In an electrolytic process for the production of chlorine and an alkali metal hydroxide from alkali metal chloride brines containing soluble, iodine-containing salts and employing an electrolytic cell comprising an anode compartment containing an anode and aqueous alkali metal chloride and a cathode compartment containing a cathode and aqueous alkali metal hydroxide, said compartments being separated by a fluorocarbon cation-exchange membrane containing at least one of the types of cation-exchange groups selected from carboxyl cation exchange groups and sulfonyl cation exchange groups and through which an electrical current is passed at a current density in the range of 20 to 80 $A/dm^2$ while continuously adding concentrated alkali metal chloride free from harmful levels of alkali earth salts, iron and other heavy metal salts to the anode compartment and continuously removing chlorine and depleted anolyte solution from the anode compartment and continuously adding water or dilute alkali metal hydroxide to the cathode compartment and continuously removing alkali metal hydroxide having a concentration maintained at a value between 20% and 45% by weight from the cathode compartment, the improvement which comprises using a concentrated alkali metal chloride having a concentration of iodine-containing salts of not higher than 1 ppm.

2. A process according to claim 1 in which the membrane is perfluorinated and contains both carboxyl and sulfonyl ion-exchange groups and in which process concentrated sodium chloride is continuously added to the anode compartment and sodium hydroxide is continuously removed from the cathode compartment.

3. A process according to claim 1 which is operated at a current density between 30 and 50 $A/dm^2$ and in which process the membrane is a perfluorinated bimembrane having a layer containing carboxyl groups facing the catholyte and a layer containing sulfonyl groups facing the anolyte and in which process the alkali metal chloride added to the anode compartment is sodium chloride and the concentration of soluble iodine-containing salts in the concentrated sodium chloride continuously added to the anode compartment is not higher than 0.4 ppm.

4. In a process for the electrolysis of an aqueous solution of sodium chloride derived from raw material salt containing iodine compounds wherein an electric current is passed through said solution in an electrolytic cell separated into an anode chamber and a cathode chamber by a cation exchange membrane, the improvement which comprises reducing the content of iodine in the aqueous sodium chloride solution charged into the anode chamber to a content not higher than 1 ppm prior to electrolysis.

* * * * *